United States Patent [19]

Steier

[11] Patent Number: 4,770,071

[45] Date of Patent: Sep. 13, 1988

[54] TOOL DRIVE MECHANISM

[76] Inventor: Sam Steier, 244-69 61st St., Douglaston, N.Y. 11362

[21] Appl. No.: 877,905

[22] Filed: Jun. 24, 1986

[51] Int. Cl.[4] ..... B25B 13/46

[52] U.S. Cl. ..... 81/63; 81/60; 81/57.22

[58] Field of Search ..... 81/63, 60, 61, 62, 63.1, 81/63.2, 58.1, 59.1, 57.22; 192/43, 43.1

[56] References Cited

U.S. PATENT DOCUMENTS

| | | | |
|---|---|---|---|
| 3,707,893 | 1/1973 | Hofman . | |
| 3,868,983 | 3/1975 | Newcomb | 81/59.1 |
| 4,265,148 | 5/1981 | Gartzke . | |
| 4,318,314 | 3/1982 | Furedi et al. . | |
| 4,474,089 | 10/1984 | Scott . | |
| 4,592,256 | 6/1986 | Bosque | 81/57.29 |

OTHER PUBLICATIONS

Barwin Pty. Limited, Sydney, Australia, *Barlow Winches Brochure,* date unknown.

*Primary Examiner*—Frederick R. Schmidt
*Assistant Examiner*—Maurina Rachuba
*Attorney, Agent, or Firm*—Wolder, Gross & Yavner

[57] ABSTRACT

A tool drive includes upper and lower coaxial manually rotatable drive members and a driven tool member at the bottom of the lower drive member. A reversible unidirectional transmissions rotatably couple both the upper and lower drive members to the driven member. The transmission coupling the lower drive member includes a peripheral ratchet formed in the lower inside face of the lower drive member. A double ended pawl rockably carried by the upper drive member with its opposite ends alternatively drive engaging the ratchet so as to provide a ratchet coupling driving in alternative opposite directions. A follower carried by the driven member engages a cam on the pawl to transfer the pawl between opposite drive positions in accordance with the angular directional relationship between the upper drive and driven members.

14 Claims, 4 Drawing Sheets

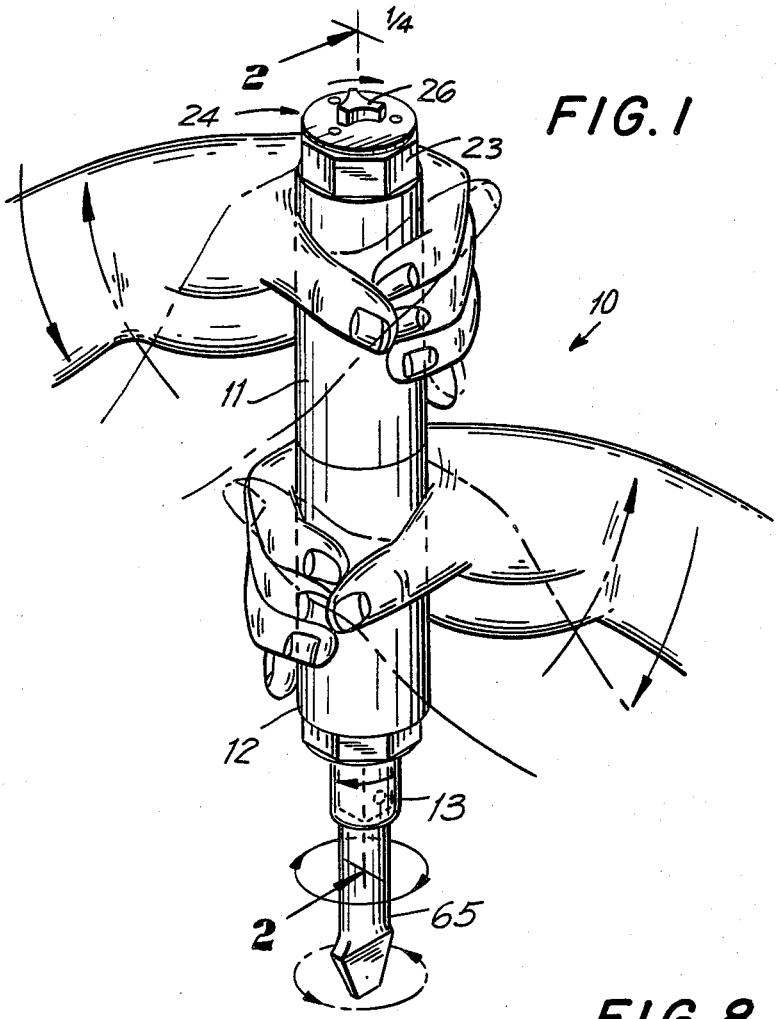
FIG. 1
FIG. 8
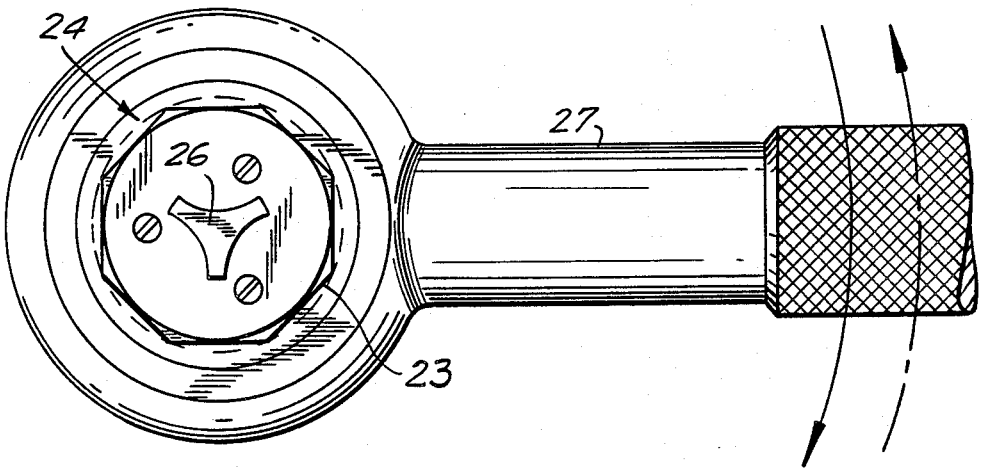

FIG. 3
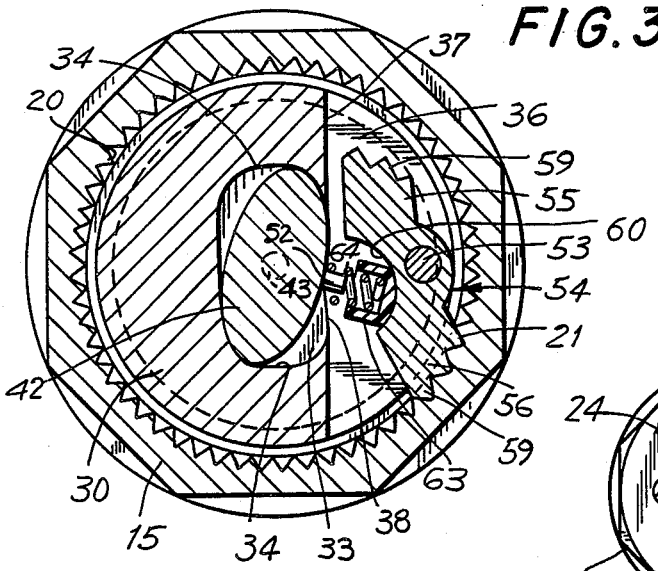
FIG. 4
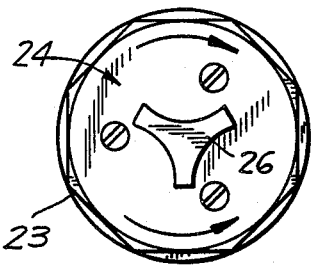
FIG. 5
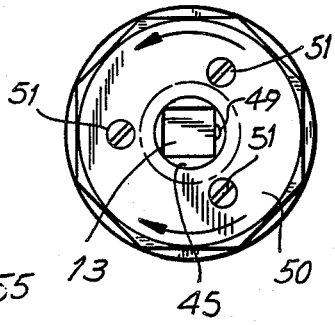
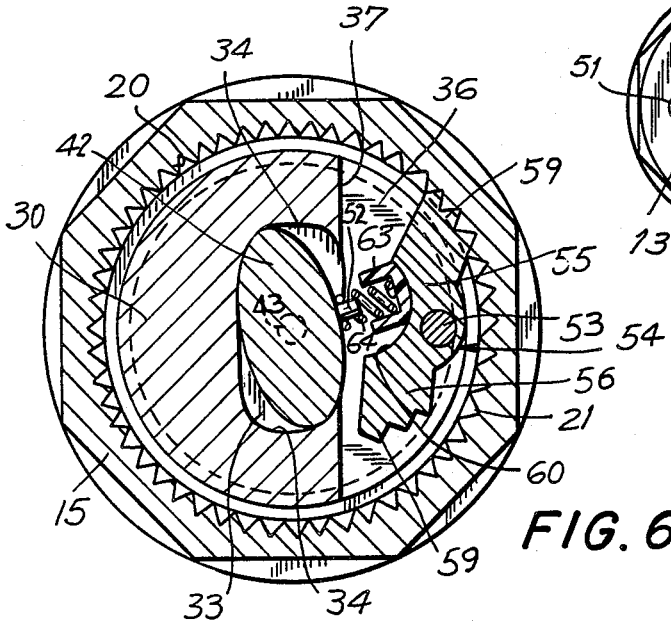
FIG. 6

TOOL DRIVE MECHANISM

BACKGROUND OF THE INVENTION

The present invention relates generally to improvements in tools and it relates particularly to an improved ratchet tool drive mechanism.

The conventional hand tool of the screw driver, sprocket wrench and drill type or the like is either of the direct drive or ratchet drive type. Each of these drive mechanisms have certain advantages as well as attendant disadvantages. Thus, in the direct drive tool, high torque and axial pressure can be applied to the work piece without damage to the tool but in many cases the tool is highly inconvenient and awkward to use and little mechanical advantage is achieved, thereby limiting the torque applied to the work piece. On the other hand, the ratchet type tools, while convenient to use under many circumstances, is frequently otherwise awkward to apply and by reason of the ratchet mechanism usually employed, is limited in the amount of torque which may be applied. Furthermore, conventional tools of the subject type are normally restricted to the use of only one hand, are of limited adaptability and versatility and otherwise leave much to be desired.

SUMMARY OF THE INVENTION

It is a principal object of the present invention to provide an improved tool.

Another object of the present invention is to provide an improved manually driven tool.

Still another object of the present invention is to provide an improved tool drive mechanism in which the tool may be selectively alternatively driven by way of a pair of ratchet couplings.

A further object of the present invention is to provide a two hand operated rotary tool drive, whereby both alternating or simultaneous hand operation may be accomplished.

Still a further object of the present invention is to provide an improved tool drive mechanism of the above nature characterized by its ruggedness, reliability ease and convenience operation and its great versatility and adaptability.

The above and other objects of the present invention will become apparent from a reading of the following description taken in conjunction with the accompanying drawings which illustrate a preferred embodiment thereof.

A tool drive mechanism in accordance with the present invention includes first and second manually accessible drive members rotatable about a common longitudinal axis, a driven member rotatable about the longitudinal axis, and unidirectional first and second coupling means coupling the first and second drive members respectively to the driven member in alternative opposite drive directions.

In accordance with a preferred embodiment of the present invention the second drive member is tubular and has a circular ratchet formed in its bottom inside face. The first drive member includes an outer tubular hand grip section projecting upwardly from the second drive member and a coaxial shaft drive coupled to the grip section by a reversible pawl and ratchet drive, the shaft terminating in an enlarged head registering with the lower part of the second drive member and having formed in its underface a diametrically extending recess with a side opening. The driven member has a top crossbar engaging and rockable in the shaft head recess and having an axially depending tool coupling. A double ended pawl is pivotal about a midpoint to the shaft head and is swingable to positions in which alternative pawl ends engage the ratchet for unidirectional drive in a respective direction and has a cam face on its radial inside face. A cam follower is mounted on the driven member crossbar and is spring biased into engagement with the pawl cam surface to swing the pawl to alternative opposite positions in accordance with the relative angular position between the first drive member and the driven member.

The improved tool device can be engaged by both hands which control and drive the tool in selected directions and direct and ratchet drive modes. The tool is easy and convenient to operate, is rugged and reliable and of high versatility and adaptability.

BRIEF DESCRIPTION OF THE DRAWINGS

FIG. 1 is a front perspective view of the improved tool illustrated as applied to the driving of a screw driver;

FIG. 3 is a view taken along line 3—3 in FIG. 2 showing the tool ratchet drive in a counterclockwise drive direction;

FIG. 4 is a top plan view taken along line 4—4 in FIG. 2;

FIG. 5 is a bottom plan view taken along 5—5 in FIG. 2;

FIG. 6 is a view similar to FIG. 3 but with the ratchet drive shown in a clockwise drive direction;

FIG. 8 is a top plan view of the tool in which an operating lever is coupled to the tool.

DESCRIPTION OF THE PREFERRED EMBODIMENT

Figure 2:
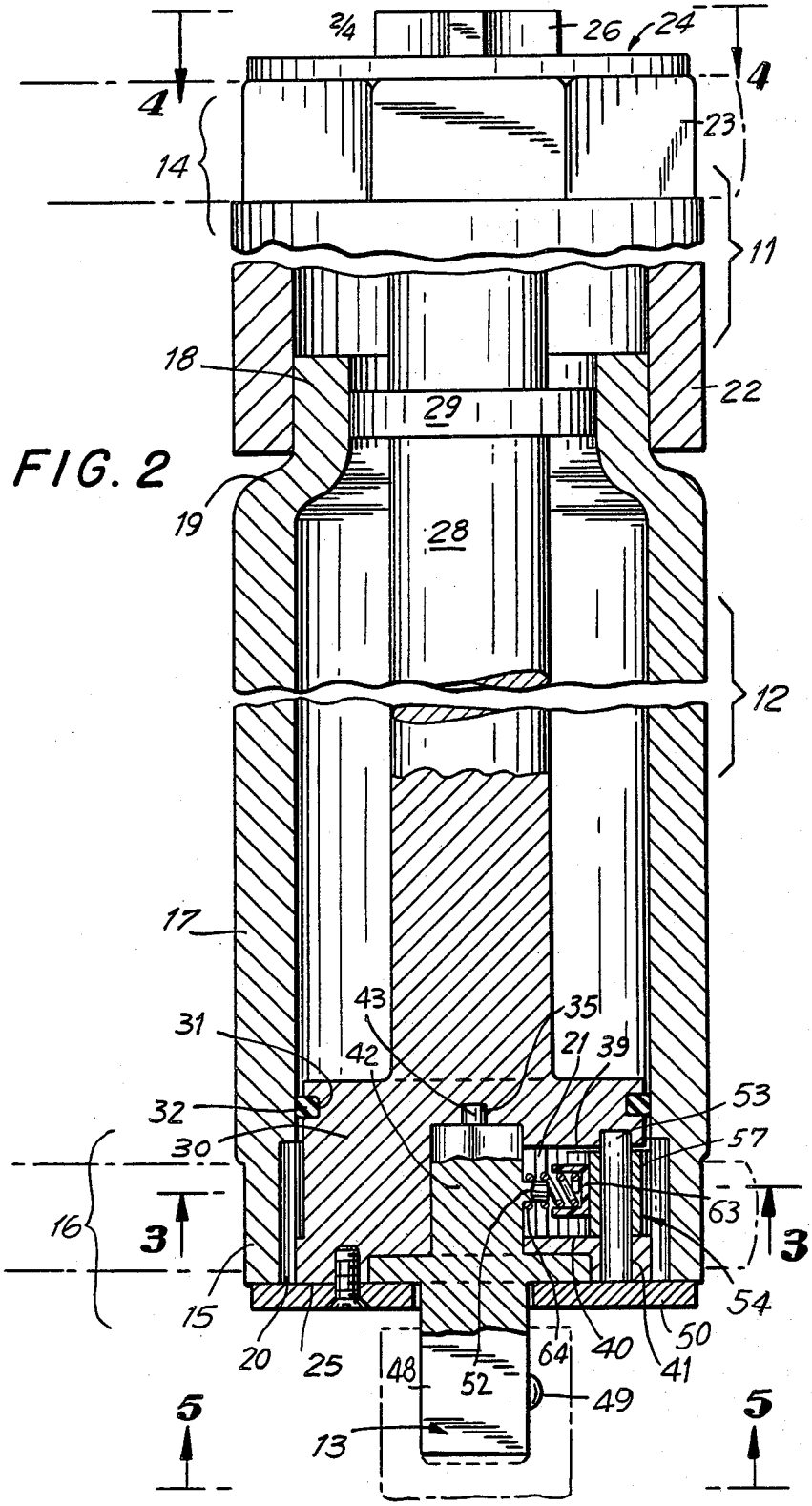
FIG. 2 is an enlarged sectional view taken along line 2—2 in FIG. 1.

Referring now to the drawings which illustrate a preferred embodiment of the present invention and initially FIG. 1, the reference numeral 10 generally designates the improved tool which includes an upper drive member 11, a lower drive member 12, a tool receiving driven member 13, and a tool 65 mounted on member 13 for contact with the work. As further seen in FIG. 2, a first unidirectional coupling 14 of conventional design drive couples upper drive member 11 to driven tool receiving member 13, and a second unidirectional coupling 16 drive couples lower drive member 12 to driven member 13 for selective unidirectional driving of driven member 13 in a chosen clockwise or counterclockwise direction in response to rotation of either upper drive member 11 or lower drive member 12. Drive members 11 and 12 and driven member 13 are coaxial and rotatable about a common longitudinal axis.

As seen in FIGS. 2 and 3, lower drive member 12 includes a main cylindrical tubular body member 17 open at its bottom and terminating at its top in a short restricted cylindrical neck portion 18 delineated from the main portion by a peripheral shoulder 19. Formed in the lower border of the inside face of main body member 17 are a plurality of peripherally spaced symmetrical teeth 20 defining a circular ratchet 21 coaxial with the drive and driven members. Body member 17 is dimensioned to be comfortably manually grasped to facilitate its manual rotation.

Referring to FIGS. 2 and 4, upper drive member 11 includes a tubular cylindrical outer body member 22 of outside and inside diameters approximately equal to those of lower body member 17, whose neck portion 18 telescopes within the lower part of body member 22 to permit their relative rotation. The upper part of body member 22 is octagonally shaped to define a wrench receiving section 23. Formed in its inside face are peripherally spaced teeth (not shown) defining a circular rack. The bottom border 15 of the outside face of lower body member 17 is likewise octagonally shaped for the reception of a wrench. A pawl assembly 24 is positioned in the upper part of body member 22 and cooperates with the surrounding ratchet to define a reversible unidirectional drive coupling at conventional or known construction drive connecting body member 22 and a coaxial shaft as will be hereinafter described. Projecting upwardly from pawl assembly 24 is a three legged spider shaped control knob 26 for adjusting the drive dirction of pawl assembly 24. A removable operating lever 27 (FIG. 8) may be provided for attachment to upper drive member 11 for increased torque drive when appropriate. A similar lever (not shown) may be used in conjunction with lower drive member 12.

Depending from pawl assembly 24 and firmly affixed thereto and coaxial with body member 22 is an internal shaft 28 of lesser diameter than that of the inside faces of body members 17 and 22, an annulus 29 located on shaft 28, rotatably engaging the inside face of neck section 18 to provide rotational rigidity. As may be seen in FIGS. 2 and 7, shaft 28 terminates at its bottom in an enlarged cylindrical head 30 of slightly less diameter than the inside face of body member 17 and having a bottom face 25 coplanar with the bottom face of body member 17. A peripheral groove 31 is formed in the upper peripheral face of head 30 and retains a bearing ring 32 which rotatably low frictionally engages the inside face of body member 17 above circular ratchet 21.

Figure 7:
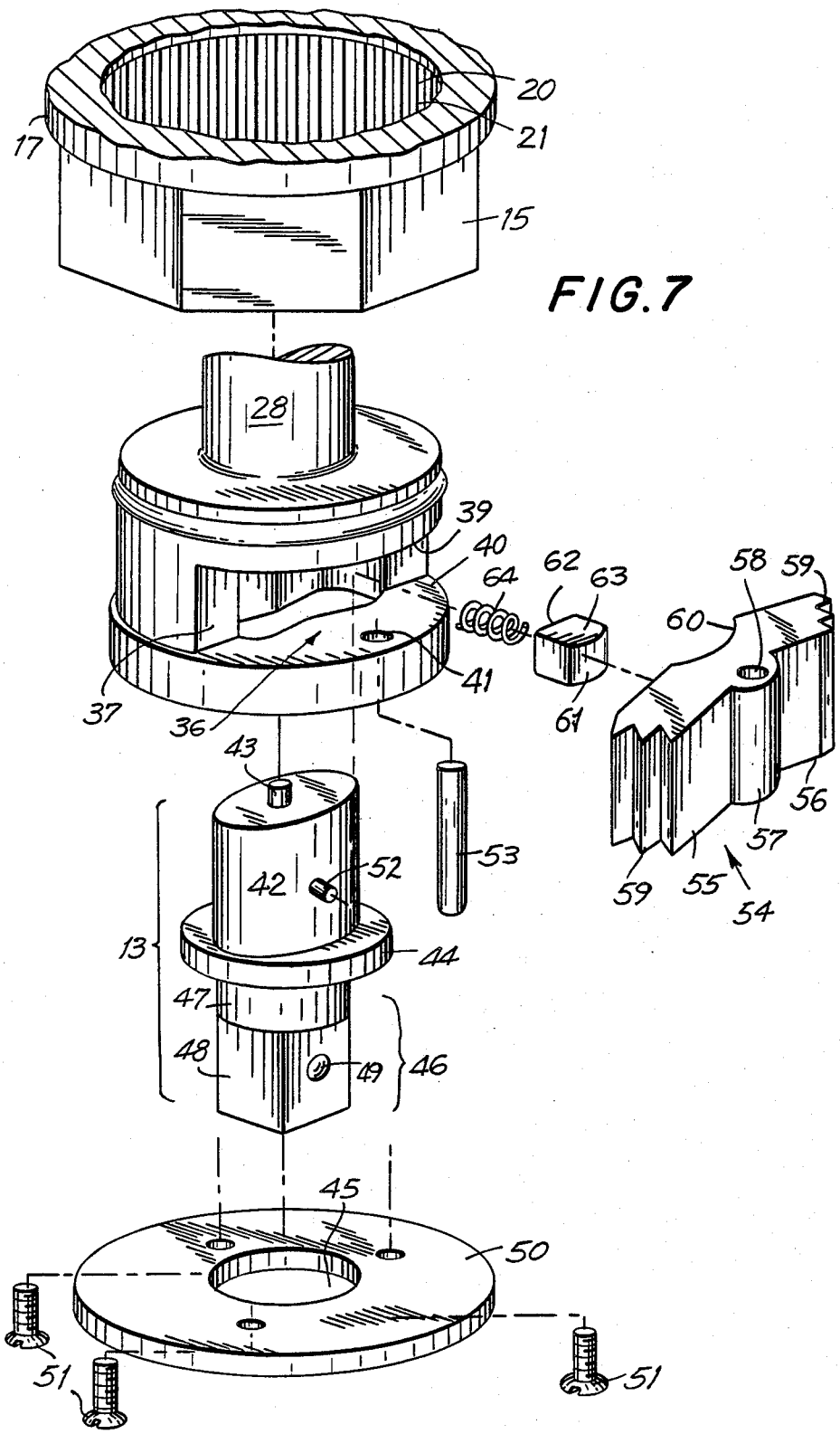
FIG. 7 is an exploded perspective view of the lower portion tool.

As seen in FIGS. 3, 6 and 7, a deep, rectangular shaped diametrically extending well 33 having rounded ends 34 is formed in the underface of head 30. A segment-shaped recess 36 is formed in the peripheral face of head 30, the chord plane 37 of recess 36 being vertical and intercepting a side face of well 34 to provide a side access opening 38 thereto. The recess 36 is delineated by horizontal top and bottom walls 39 and 40 respectively, a vertical bore 41 being medially formed in bottom wall 40 proximate its peripheral edge in axial alignment with a corresponding bore formed in top wall 39. A short central bore 35 is formed in the base of well 33 coaxial with shaft 28.

Referring to FIG. 7, driven member 13 includes an upper section 42 of oval transverse cross section and having an integrally formed upwardly projecting axial pivot pin 43, a radially enlarged circular intermediate section 44, and a tool holding lower section 46. The upper part 47 of tool holding section 46 is of circular transverse cross section. The bottom part 48 is of square transverse cross section and carries an outwardly spring-biased ball detent 49. It should be noted that while tool holding part 48 is shown as of the type employed with tool heads having square coupling sockets it may be of any other type of tool-retaining chuck or tool.

Driven member upper section 42 is located within head recess 34, with pivot pin 43 rotatably engaging the mating axial bore 35 in the top face of recess 33 so that driven member 13 is rockable relative to shaft 28, which is drive coupled to driven member 13 by a lost motion connection, defined by driven member upper section 42 and recess 33. Driven member intermediate section 44 rotatably nests in a mating recess in the underface of enlarged head 30 and is retained therein by a circular bottom plate 50 secured by screws 51 to the underface of head 30 and having a central opening 45 rotatably engaging cylindrical portion 47, the peripheral border of the upper face of plate 50 slidably abutting the bottom face of body member 17. A medially located pin 52 projects radially outwardly from the side face of drive member upper part 42 toward the side opening of recess 34.

As seen in FIGS. 3, 6 and 7, vertical pivot pin 53 has its bottom portion engaging bore 41 and its upper part engaging the axially aligned bore in the underface of head top wall 39. The second drive coupling 16 comprises a double ended pawl 54 including a pair of symmetrical opposite wings or arms 55 and 56 forming an obtuse dihedral angle and having along their vertical intersection a radially outwardly projecting cylindrical projection 57 provided with a vertical bore 58. Pawl 54 is sandwiched between head top and bottom walls 39 and 40, bore 58 rotatably engaged by pivot pin 53. Each of the pawl wings 55, 56 terminates in vertical toothed pawl faces 59 which mate ratchet teeth 21. The pawl 54 is rockable between alternative opposite positions in which one or the other pawl faces 59 engages the ratchet 21 while the opposite pawl respective wing is disengaged and withdrawn to a position entirely between the head top and bottom walls 39 and 40.

A concave vertical cylindrical cam face 60 is medially formed on the radial inside face of pawl 54 and is horizontally slidably engaged by a correspondingly curved outside face 61 of a hollow cam follower 63, open at its opposite, inwardly directed end 62. A helical compression spring 64 has its inner end encircling radially projecting pin 52 and its outer portion housed within the open end 62 of follower 63 and bearing on the inside face of the followers' radial outer wall to resiliently bias the follower 63 into sliding engagement with pawl cam face 60 to alternatively resiliently urge a respective pawl end into engagement with ratchet 21 in response to the part of cam face 60 engaged by follower face 61.

In employing the tool drive device 10 described above, a replaceable tool, for example a socket replaceable screw driver 65 as illustrated in FIG. 1 is coupled to the drive member coupling section 48, and may be rotated in either desired direction by appropriately setting control knob 26 and manually rotating or rocking upper body member 22 relative to screw driver 65 to set the appropriate way of pawl 54 in ratchet contact with ratchet 21. With the rotation of upper drive member 11 the recessed head 30 rotates in the drive direction set by knob 26 until opposite ends of driven member section 42 of member 13 are engaged by the respective faces of recess 34 to rotate the tool carrying member 13. The relative counterclockwise and clockwise rotation positions of the drive members 11 and 12, driven member 13 and the drive couplings are shown in FIGS. 3 and 6 respectively. Thus in both these positions the upper and lower drive members are drive coupled through respective unidirectional transmissions to the driven member in a common drive direction and either or both drive members may be rotated in a common direction or in alternate opposite directions to rotate the driven member in only the direction preselected by control knob 26.

Drive of tool 65 is also accomplished by rotation of the lower drive member 12, the driven member 13 again being driven in a single direction depending on the setting of pawl 54 in accordance with the directional rotation of which depends on the setting of knob 26 upper drive member 11. Thus, if the tool 65 is to be rotated counterclockwise, knob 26 is adjusted for such counterclockwise drive transmission. Initially the driven member 13 is restrained from rotating, the upper drive member is rocked, and shaft 28 and head 30 are thus rotated counterclockwise to the relative positions shown in FIG. 3 wherein follower 63 bears on the counterclockwise trailing end of cam face 60 to bias pawl section 55 into engagement with ratchet 21. In this condition, counterclockwise rotation of lower drive member 12 rotates driven member 13 by way of pawl portion 55, pin 53, head 30 and driven member section 42. On the other hand, if lower drive member 12 is rotated clockwise the rotating ratchet 21 causes the clockwise rocking of pawl 54 about pin 53 and the disengagement and slipping between the pawl and ratchet and the drive uncoupling in such clockwise rotation of lower drive member 12. Thus oscillation of either of both drive members rotates the driven member counterclockwise. Either drive member may be in the slip mode while the other is in the drive mode, thus allowing both hands to move simultaneously for continuous drive. It is to be noted that both drive members drive tool 65 through head 30, thus eliminating cam follower 63 as a drive element and accordingly eliminating potentially destructive forces on this element.

If the driven member 13 is to be driven in a clockwise rotation the control knob 26 is adjusted for clockwise pawl and ratchet transmission drive, the rotation of head 30 is restrained and the upper drive member 11 is rocked so that shaft 28 is rotated in a clockwise direction bringing the different components to the relative positions illustrated in FIG. 6 so that the lower drive member 12 and driven member 13 are ratchet drive coupled to rotate the driven member in a clockwise direction in a similar but opposite manner to that explained in connection with the ratchet counterclockwise rotation of the driven member.

While there have been described and illustrated a preferred embodiment of the present invention it is apparent that numerous alterations, omissions and additions may be made without departing from the spirit thereof.

What is claimed is:

1. A tool drive mechanism comprising first and second drive members rotatable about a common longitudinal axis, a driven member rotatable about said axis, first unidirectional coupling means rotatably drive coupling said first drive member and said driven member and second unidirectional coupling means rotatable coupling said second drive member and said driven member in alternative opposite drive directions for continuous rotation of said driven member upon rotation of said first and second drive members, said first drive member having a diametrically extending recess formed in the bottom face thereof and said driven member having a diametric crossbar in the upper part thereof engaging and rockable in said recess about said longitudinal axis, said recess and crossbar defining a lost motion transmission.

2. The tool drive mechanism of claim 1 wherein said second drive member comprises an elongated tubular hand grip, said first drive member comprises an upper section extending above said second drive member and a shaft extending from said upper section coaxially through said second drive member and said driven member is located at the lower portions of said shaft and second drive member.

3. The tool drive mechanism of claim 2, wherein said shaft terminates at its lower end in an enlarged cylindrical head in which said recess is formed and said second coupling means couples said enlarged head to said second drive member.

4. The tool drive mechanism of claim 1 wherein said second coupling means comprises an inside toothed annular ratchet located on said second drive member and a double ended pawl mounted on said first drive member in registry with said ratchet and swingable about an axis between the ends thereof which alternatively engage said ratchet.

5. The tool drive mechanism of claim 4 wherein said pawl is swingably mounted on a pivot pin carried by said first drive member radially offset from said longitudinal axis and having a radially inwardly facing cam surface and said second coupling means further comprises a follower rotatable with said driven member and urged into engagement with said cam surface.

6. The tool drive mechanism of claim 4 wherein said second drive member has an inside peripheral face and said ratchet is integrally formed with said second drive member on said inside face.

7. The tool drive mechanism of claim 1 wherein said first coupling is a reversible unidirectional drive transmission coupled in tandem with said lost motion coupling means between said first drive member and said driven member.

8. A tool drive mechanism comprising a manually rotatable first drive member, a manually rotatable second drive member, a tool driving driven member, a manually controllable reversible unidirectional first drive transmission coupling said first drive member to said driven member, a reversible unidirectional second drive transmission responsive to the direction of drive of said driven member by said first drive member coupling said second drive member to said driven member, and a lost motion rotary coupling connecting said first drive member and said driven member in tandem with said first drive transmission.

9. The tool drive member of claim 8 wherein said second drive transmission is responsive to the angular relationship between said first drive member and said driven member.

10. The tool drive mechanism of claim 8 wherein said drive and driven members are coaxial.

11. A tool drive mechanism comprising a lower tubular drive member rotatable about a vertical longitudinal axis, an upper rotatable drive member extending above said lower drive member and including a shaft extending axially through said lower drive member, a driven tool member located at the lower part of said lower drive member and rotatable about said longitudinal axis, first coupling means including a lost motion section rotatably drive coupling said shaft and said driven tool member and second coupling means unidirectionally rotatably coupling said lower drive member and said driven tool member in alternative opposite directions in response to the relative rotation between said shaft and said driven tool member, said second coupling including a circular ratchet formed on the inside face of said lower drive member proximate its lower end, a pivot pin mounted on said shaft parallel to said longitudinal axis and a double-ended pawl rockably mounted on said pivot pin with its ends alternatively engaging said ratchet and having a radially inwardly facing cam surface and a follower carried by said driven member and rotatable therewith and spring urged into engagement with said cam surface.

12. The tool drive mechanism of claim 11 wherein said lost motion section is defined by a diametrically extending recess formed in the underface of said shaft and a diametrically extending stub shaft projecting upwardly from said driven member and rockably engaging said recess.

13. The tool drive mechanism of claim 11 wherein said upper rotatable drive member includes a manually rotatable section and a manually selectively reversible unidirectional transmission drive coupling said manually rotatable section to said shaft.

14. A tool drive mechanism comprising a manually rotatable first drive member, a manually rotatable second drive member, a tool driving driven member, said drive and driven members being coaxial, a unidirectional first drive transmission coupling said first drive member to said driven member and including means for transferring said first transmission between forward and reverse unidirectional drive settings, a reversible unidirectional second drive transmission coupling said second drive member to said driven member and means for transferring the setting of the drive direction of said second transmission in response to the drive direction of said first transmission.

* * * * *